US005369939A

United States Patent [19]

Moen et al.

[11] Patent Number: 5,369,939

[45] Date of Patent: Dec. 6, 1994

[54] HIGH SPEED LIDDER

[75] Inventors: Lenard E. Moen; Ronald D. Pounds, both of Whittier, Calif.

[73] Assignee: Moen Industries, Inc., Santa Fe Springs, Calif.

[21] Appl. No.: 35,663

[22] Filed: Mar. 23, 1993

[51] Int. Cl.[5] ..... B65B 7/28; B65B 49/08

[52] U.S. Cl. ..... 53/485; 53/488; 53/491; 53/306; 53/312; 53/376.5

[58] Field of Search ..... 53/488, 491, 487, 485, 53/306, 310, 312, 387.1, 376.3, 376.4, 376.5

[56] References Cited

U.S. PATENT DOCUMENTS

| | | | |
|---|---|---|---|
| 2,848,856 | 8/1958 | Brock | 53/287 |
| 2,955,400 | 10/1960 | Levkoff | 53/228 |
| 3,138,905 | 6/1964 | Ellinger | 53/47 |
| 3,501,895 | 3/1970 | Geyer | 53/310 X |
| 3,516,227 | 6/1970 | Baker et al. | 53/310 X |
| 3,634,995 | 1/1972 | Curtis | 53/306 X |
| 3,688,466 | 9/1972 | Geyer | 53/67 |
| 3,896,607 | 7/1975 | Royal | 53/287 |
| 3,913,300 | 10/1975 | Benzing | 53/287 |
| 3,951,049 | 4/1976 | Brackmann et al. | 53/485 X |
| 3,979,883 | 9/1976 | Patsaros | 53/306 |
| 4,150,523 | 4/1979 | Gentili | 53/310 X |
| 4,671,046 | 6/1987 | Lewis et al. | 53/387.1 X |
| 4,674,261 | 6/1987 | Sabel | 53/242 |
| 4,745,728 | 5/1988 | Valenti | 53/306 X |

*Primary Examiner*—Horace M. Culver
*Attorney, Agent, or Firm*—Frederick E. Mueller

[57] ABSTRACT

A lidding apparatus has a pair of brake shoes which elevate a box from a conveyor, the box being decelerated by the brake shoes. A lidding assembly includes an opposite pair of grooves with a release configuration for supporting a flat lid blank but allowing the flaps of the blank to rotate out of the grooves. The lid blank is maintained in a flat condition as the lid blank and box are bought into mutually centered contact whereupon the side flaps are rotated toward the box through the clearances provided by the release configuration by shoes of the lidding assembly.

22 Claims, 7 Drawing Sheets

HIGH SPEED LIDDER

The present invention relates to packaging machinery and more particularly, to a method and machine for forming and applying a lid to a paperboard box that has previously been loaded with a product.

BACKGROUND OF THE INVENTION

It is common practice in the packaging industry to fill a paperboard box with a product and, thereafter, to secure a lid to the open top of the loaded box. A variety of lidding machines have heretofore been devised for this purpose of the type in which the machine forms the lid from a precut blank around the top of the box and secures the lid in place by a fastening means such as glue or staples. Several problems have been encountered with such machines, particularly in situations where the preloaded box contains unstable articles such as tall bottles, or the box is of the display type having an abbreviated wall or walls, or when a hot melt adhesive is used to secure the lid to the preformed box.

More particularly, when the box contains unstable articles, the infeed conveyor of the lidding machine must decelerate and accelerate the loaded boxes relative to the lidding station at low rates in order to prevent jarring and tipping of the contained products. In lidding machines wherein a hot melt adhesive is used to secure the lid to a display box, the upper ends of the box walls have a small resistance to deflection when compression is applied to disperse the glue between the lid flanges and the side wall of the box. Accordingly, as a low compression force is applied, the dwell time of compression is relatively great, the box may be distorted, and the production rate of the lidding machine is correspondingly diminished. These and other disadvantages of the prior art machines are obviated or diminished by the present invention.

SUMMARY OF THE INVENTION

The machine comprises a framework having a high speed endless belt conveyor through a lidding station. A gate at the entrance into the conveyor is cyclicly opened and closed to periodically admit a preloaded box into the lidding station. Within the lidding station, adjacent to each of the opposite sides of the endless belt, is a retracted elongate brake shoe, each of which at the downstream end incorporates a stop member to arrest the box in an indexed position. The box is laterally restrained between a pair of fixed guides on opposite sides of the conveyor belt and, after the box has been arrested by the stop blocks of the elongated brake shoes, a pair of back blocks are laterally swung into contact with the trailing end of the indexed box.

Each of the brake shoes is generally L-shaped in cross-section and parallel to an adjacent bottom edge of the box. Each of the brake shoes is mounted on a pivotal axis paralleling the brake shoe and the adjacent box bottom edge and by means of a double pneumatic cylinder is raised in two steps from the retracted position into intermediate and fully elevated positions. In the intermediate position, the brake shoes lift the box from the conveyor and serve to gradually decelerate the box until it engages the downstream stop blocks, the box sliding on the horizontal flanges of the brake shoes. In the fully extended position the box is further lifted away from the conveyer belt and raised into a fully indexed position and clamped between vertical flanges of the pair of shoes in readiness for application of a lid thereto.

The lidding station has a lateral frame section comprising a magazine for preformed blanks that have been cut and scored in readiness to be formed as a lid around the upper end of the indexed box. The lid blanks are individually retrieved from a stack thereof by a vacuum cup assembly to deliver the lid blank onto a shuttle mechanism that transports the lid blank through a glue application station into an indexed position within a fold and compression sub-assembly. The fold and compression assembly includes an opposite pair of longitudinally grooved guide rails to receive opposite edges of a lid blank as well as a pair of stops to arrest the blank in the indexed position. In the indexed position of the lid, the fold lines of its marginal flaps and tabs are in registration with the upper end of the elevated and loaded box.

The fold and compression assembly is mounted for vertical reciprocation by means of a linear thruster on the machine framework and incorporates, on one pair of opposite sides, a pair of shoe means with glue compression plates, and on the other pair of opposite sides, a pair of rolls. The shoe means and the rolls are in alignment with flap and tab portions of the lid blank to progressively fold them downwardly onto sidewalls of the box as the fold and compression sub-assembly descends. During descent of the fold and compression assembly, compressively padded hold down plates, each of which is in registration with a corresponding corner of the box, apply a compressive force against the top surface of the lid and onto upper edge portions of the box cornerposts prior to actuation of the glue compression plates to prevent displacement of the sidewalls as a result of the compressive force of the plates.

DETAILED DESCRIPTION OF THE PREFERRED EMBODIMENT

Figure 2:
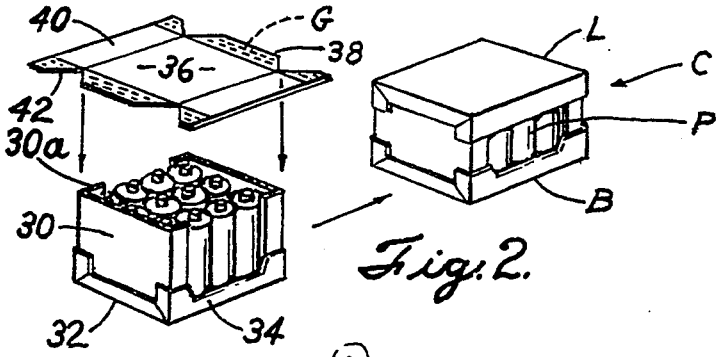
FIG. 2 is an exploded perspective view of a box and lid and a complete lidded box exemplary of containers to be lidded by the machine of FIG. 1.

Before explaining the invention in detail, it is to be understood that the invention is not limited in its application to the precise details of construction and the arrangement of the components set forth in the following description or illustrated in the drawings. The invention is capable of other embodiments and of being practiced and carried out in various ways. Also, it is to be understood that the phraseology and terminology employed herein is for the purposes of description and should not be regarded as limiting.

The machine of our invention can be used to form and apply lids of a sheet material to virtually any kind of box. By way of illustrating a demanding application of the invention, FIG. 2 shows a display container C comprising a lid L closing the top of a Bliss style display box B, loaded with a plurality of products P which may be assumed to be tall and relatively narrow bottles. The Bliss box comprises an opposite pair of full height end panels 30, having vertical side flanges 30*a* to provide cornerposts, integrated with a body wrap 32. The latter has upturned marginal flaps, a pair 34 of which comprise abbreviated walls to define openings in the container through which the product can be viewed. It will be appreciated by persons knowledgeable in the packaging art that this situation presents an extreme challenge to machine lidding in that the walls 30 at their unreinforced upper ends are ill adapted to resist deformation during gluing of the lid thereto, difficult to maintain in registration with the fold lines of the lid, and the loaded, unlidded box B can spill products P out of the display window if too sharply accelerated or decelerated.

It will be appreciated that the geometry of the lid L will vary from case to case consistent with the style and dimensions of the box to be lidded. In the illustrated case, the lid L is made from a scored flat blank having a central top panel 36 with integral opposite side foldable marginal flaps 38 and a pair of integral opposite end flaps 40 each of which has a pair of opposite side marginal foldable end tabs 42.

Figure 1:
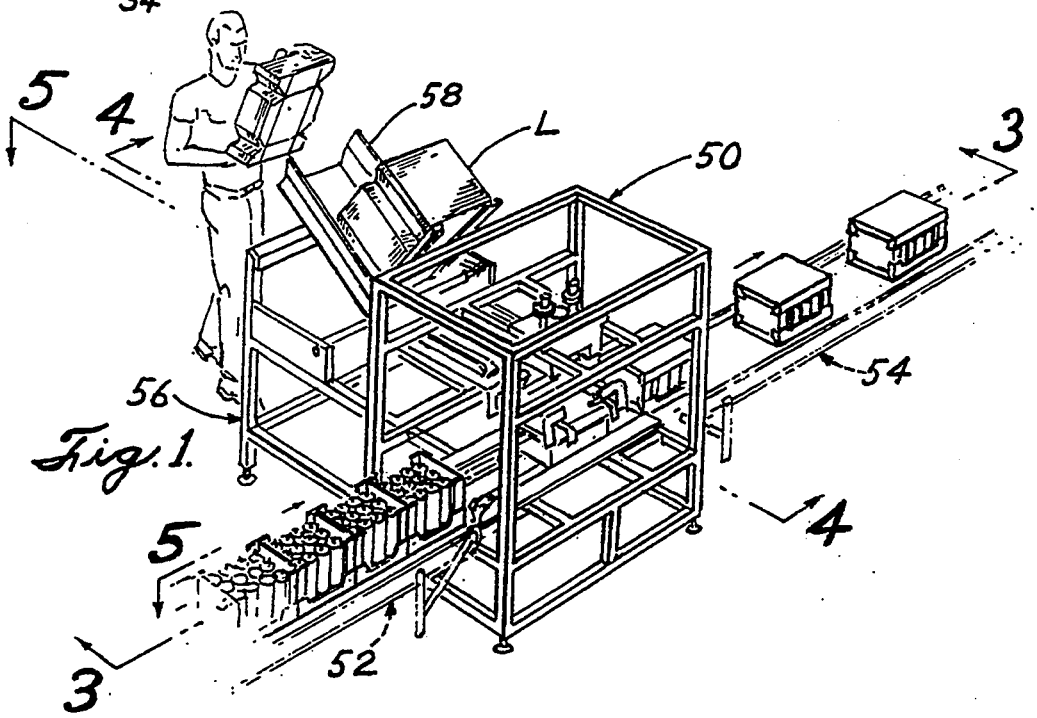
FIG. 1 is a perspective view of a lidding machine incorporating our invention.

Referring to FIG. 1, the lidding machine comprises a main framework 50 adapted to be interposed between the user's input conveyor 52 and output conveyor 54. Extending laterally with respect to the production line the main frame 50 includes an auxiliary frame 56 incorporating a supply chute 58 of generally U-shaped cross-sectional configuration to hold a stack of the lid blanks L. The in feed conveyor 52 carries a series of boxes B loaded with the product P which are sequentially fed into the main frame 50 to be lidded and then exhausted from the main frame 50 as sealed containers C on the output conveyor 54.

The main frame 50 is of conventional construction made up of lengths of square tubing and/or angle iron or the like and, in a base section, thus provides support for rotatably mounting parallel spaced apart rolls 60 and 62 around which an endless belt 64 is trained. The rolls 60 and 62 are positioned to support the belt 64 in alignment with the in feed conveyor 52 and output conveyor means 54. The top surface of the upper flight of the belt 64 occupies substantially the same plane as the running surfaces of the conveyor means 52 and 54. A motor 66 is mounted on the framework beneath the belt 64 and has an output shaft 68 with a sprocket wheel, or the like, around which an endless chain is trained in operative driving association with the belt supporting roll 62.

On the upstream side of the base section of the main frame 50, a spaced pair of upstanding brackets 74 support a parallel spaced apart pair of rollers 76, whose upper surfaces are also in substantially the same plane as the running surface of the upper flight of the endless belt 64. Similarly, at the downstream side of the main frame, a pair of brackets 78 support a single roller 80 oriented in the same fashion as rollers 76. The upstream side of the framework also supports a vertically oriented pneumatic cylinder 84 which at the outer end of its piston rod has a gate member 86 positioned between the rolls 76.

The gate 86 may comprise a flat metal plate receivable with clearance between the rolls 76 and is coupled to a spring means (not shown) that normally biases the gate upwardly into a position extending up above the upper surfaces of the rolls as a line stop to arrest the progress of boxes B on in feed conveyor means 52. Upon actuation of the pneumatic cylinder 84, the gate is momentarily retracted to a position beneath the upper surfaces of the rolls 76 to admit a single box B into the lidding station, after which a conventional control means, e.g., a photo electric cell, effects de-energization of the pneumatic cylinder 84 whereupon the spring means snaps the gate 84 upwardly into interfering position to arrest the next box B.

Figure 3:
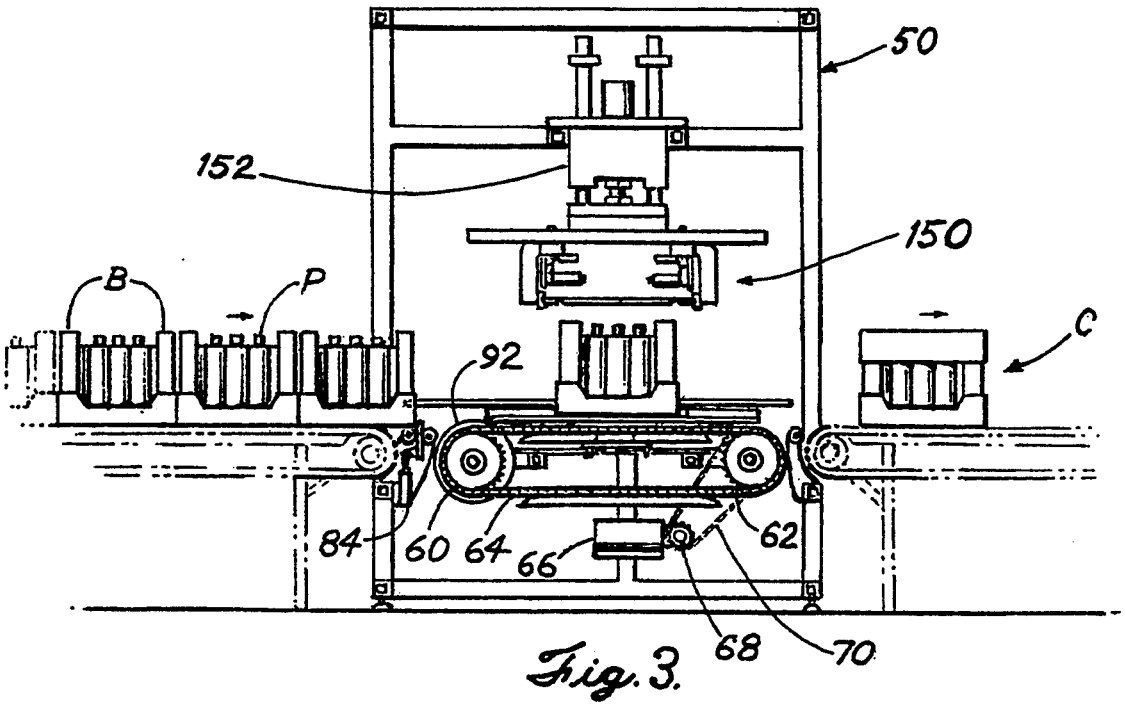
FIG. 3 is a vertical sectional view of the machine of FIG. 1, taken on the line 3—3.
Figure 6:
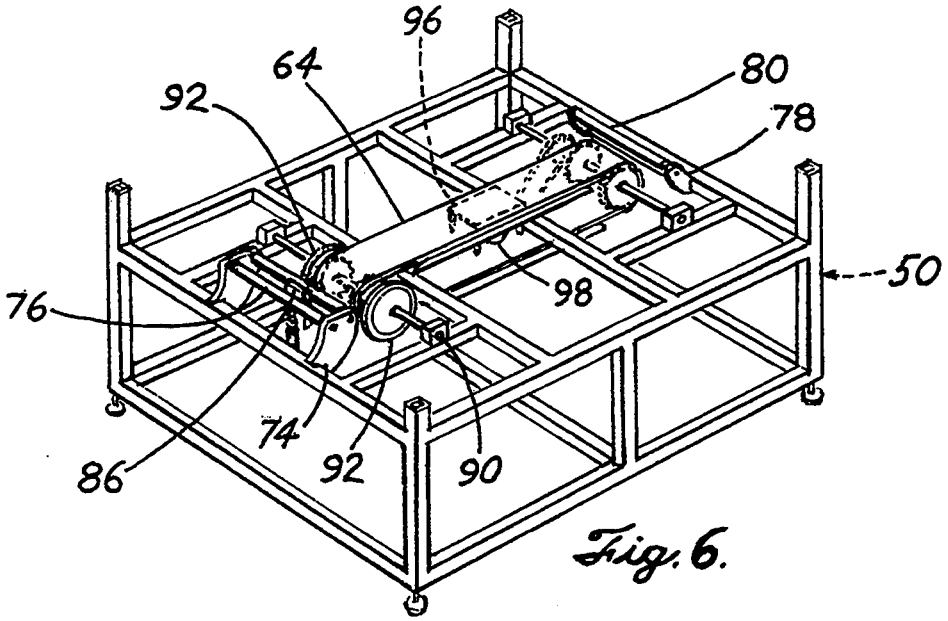
FIG. 6 is a perspective view of the base portion of the machine of FIG. 1, portions being removed to more clearly illustrate the conveyor belt mechanism and its upstream gate.

Referring to FIG. 6, a shaft 90 that coaxially supports the upstream roll 60 also coaxially supports an opposite pair of accelerator or driver wheels 92 having a circumference for engaging the bottom of a box B. As is best seen in FIG. 3, the wheels 92 are of a diameter slightly larger than that of the roll 60, e.g., ½ inch such that the upper or running surface of the wheels 92 is in a plane slightly above the running surface of the upper flight of the belt 64. The belt 64 is driven at a speed, e.g., 240 feet per minute, substantially greater than the lineal speed of in feed conveyor means 52, e.g., 60 feet per minute, Thus when the gate 86 is opened a box B upon engaging the drive wheels 92 is slip-accelerated on the belt 64 into the lidding station.

Referring to FIG. 6, the framework provides support for a plate 96 stationarily positioned in sliding contact with the underside of the upper flight of belt 64. The plate 96 is driveably connected to a pneumatic cylinder 98 also supported on the framework. As will subsequently appear, plate 96 and cylinder 98 are operatively coupled to the control mechanism of the device such that if a box B is not properly indexed against downstream stops of the brake shoes, cylinder 98 is energized to lift the upper flight of the continually running belt so that the box will be advanced against the downstream stops after which other components of the control system de-energize the pneumatic cylinder 98 to retract plate 96.

Figure 9:
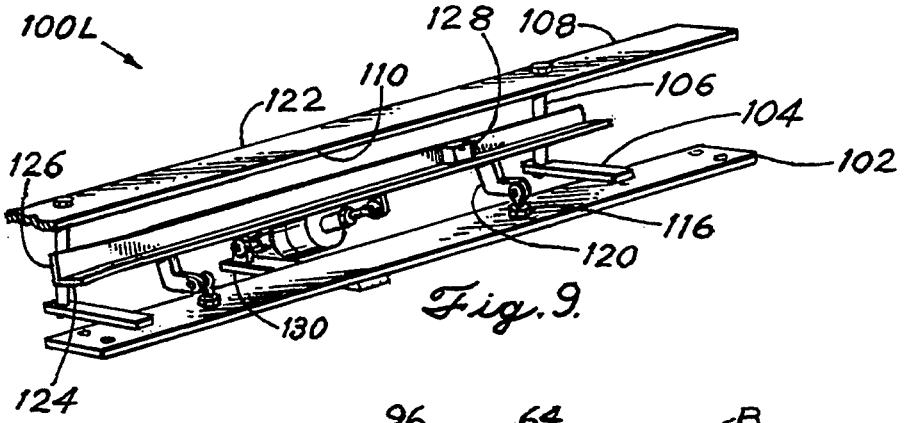
FIG. 9 is a perspective view, partly in section, of one of the brake shoe mechanisms.
Figure 10:
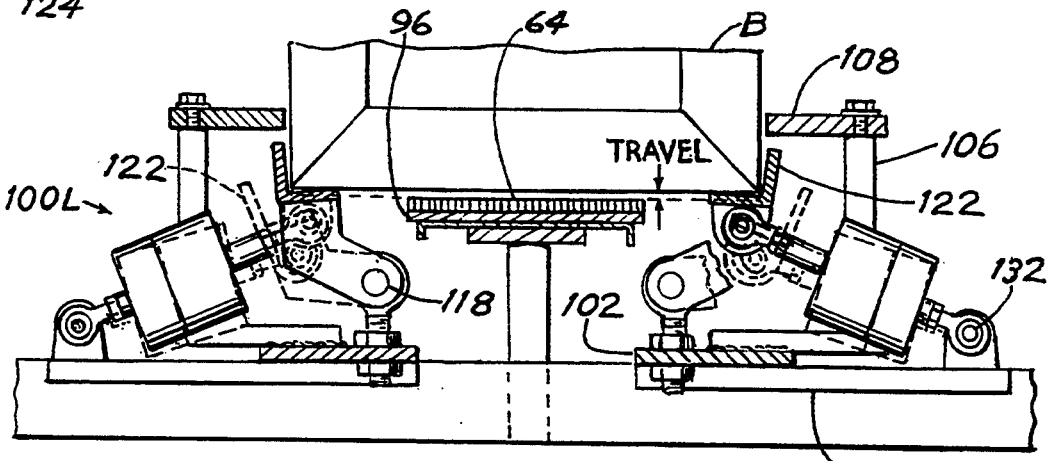
FIG. 10 is a transverse sectional elevational view on the line 10—10 of FIG. 7.
Figure 11:
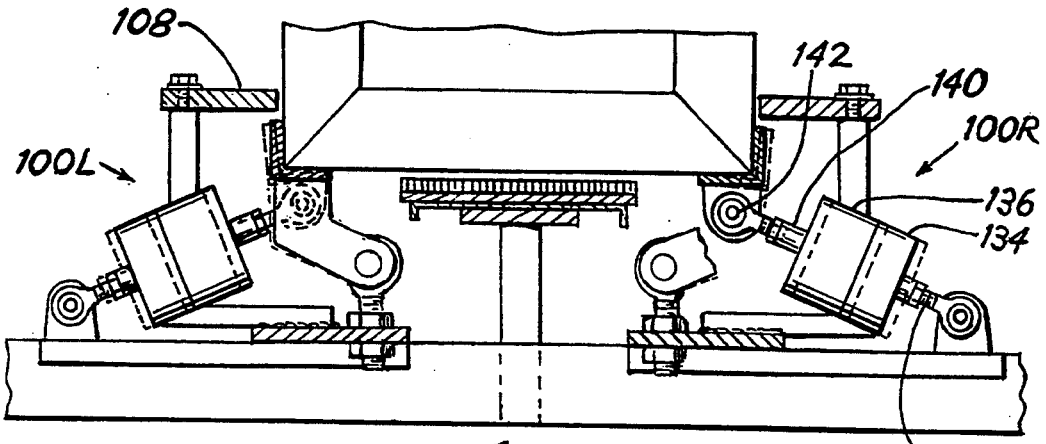
FIG. 11 is a view like FIG. 10 but showing part of the mechanism in different positions.

Referring to FIGS. 9–11, the lidding station has a pair of brake shoe assemblies, 100L and 100R positioned on opposite sides of the belt 64 in parallel relation thereto. The brake shoe assemblies are mirror images of one another so that it will be understood as the description proceeds that like parts are designated by the same numeral.

Figure 7:
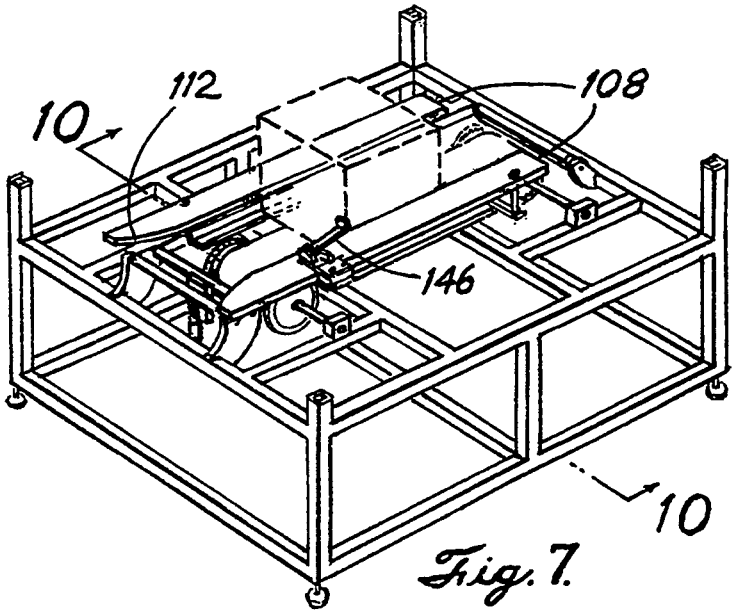
FIG. 7 is a view similar to FIG. 6 but with added structural elements.

Each of the brake assemblies includes a mounting bar 102 secured at appropriate locations to portions of the main frame 50 adjacent its opposite ends. The bar 102 is fitted with a pair of straps 104 extending laterally outwardly from the bar 102. Outer ends of the straps 104 each fixedly support an upstanding stud means 106, whose upper ends fixedly support an elongate guide plate 108 in parallel relation to the belt 64. The pair of guide plates 108 have parallel confronting edges 110 approximately spaced apart the corresponding dimension of a box B. As is seen in FIG. 7, the upstream end portions of the guide edges 110 have a tapered section 112 defining a throat between them that converges in the downstream direction. A smooth accelerated transition of a box B from the in feed conveyor means 52 into the lidding station is thus assured with respect to lateral guidance of the box.

The support bar 102 also has a longitudinily spaced apart pair of eyebolts 116 secured thereto whose upper ends contain a coaxial pair of pivot pins 118. Each of the pins 118 pivotally supports one end of a bell crank member 120 whose swingable ends are secured to opposite end portions of an elongate brake shoe 122. Each brake shoe is supported in parallel relation to the midline of belt 64 and comprises a length of angle iron having a generally horizontal flange 124 and a generally vertically extending flange 126. Adjacent its downstream end portion each brake shoe 122 is rigidly fitted with a stop block 128.

Figure 8:
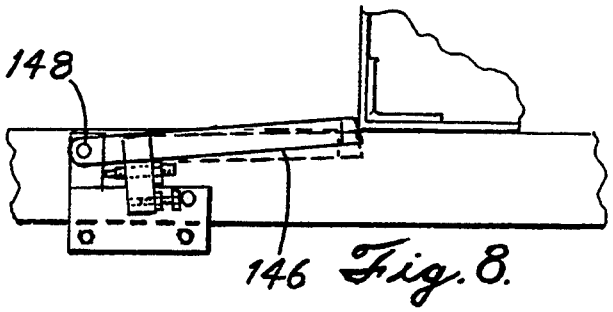
FIG. 8 is a detailed view of a latch mechanism of FIG. 7.

In an upstream portion, each bar 102 on its upper surface has a back stop arm 146 having vertical pivot axis 148 from which it trails downstream. The arm 146 is spring based to normally have its downstream end interfering with the progress of a box B but yields to the dotted outline position of FIG. 8 to allow passage of the box to fully indexed position, after which the arm resumes the solid outline position. The extreme end face of spring loaded arm 146 is a cam face serving to bias and urge the box B against the stops 128. As indicated in FIG. 8, each arm 146 is fitted with set screw mechanisms to limit its range of lateral reciprocation.

In a mid portion, each support bar 102 is fitted with a laterally outwardly projecting support bracket 130 whose outer end is fitted with an upstanding part to support a pivot pin 132. A pair of pneumatic cylinders 134 and 136 are coupled together as a unitary assembly having their butt ends in mutual contact and coaxially oriented such that a piston rod 138 of the cylinder 134 has its outer end pivotally connected to the pin 132 while a piston rod 140 of the cylinder 136 has its outer end pivotally connected to a pin 142 supported in a bracket or ears secured to the underside of the horizontal flange 124 of a brake shoe 122.

When the gate 86 is retracted, the in feed conveyor means 52 advances a box B into contact with the accelerator means or wheels 52 and onto the conveyor belt 64. The box is then immediately accelerated into the lidding station. In this phase, the cylinders 134, 136 of the brake shoe assemblies 100L and 100R are de-energized so that the pair of shoes 122 occupy the phantom outline positions shown in FIG. 10, fully retracted out of contact with the box B.

After a box has been advanced sufficiently to penetrate the lidding station, the pair of cylinders 136 are energized to raise the pair of brake shoes 122 into the solid outline position illustrated in FIG. 10. Thereupon, the horizontal flanges 124 of the brake shoes raise the box B off of conveyor belt 64 and the box begins to decelerate as a result of sliding friction. The box is finally arrested by contact between its leading edge and the pair of stop blocks 128. If the box fails to reach the stop blocks, the cylinder 98 is actuated as previously described to lift continually running belt 64 into contact with the box bottom to nudge the box downstream against the stop blocks 128. In any event, when the control means of the device senses that a box B has arrived in an indexed position against the stop blocks 128, and back stop arms 146 engage the trailing wall of the box, the pair of cylinders 134 of the brake shoe assemblies 100L and 100R are energized to advance the pair of brake shoes 122 into the solid outline position shown in FIG. 11. A box B is now further elevated away from the belt 64 and clamped between the vertical flanges 126 of the pair of brake shoes, fully indexed in readiness to be lidded with a lid blank L.

Figure 12:
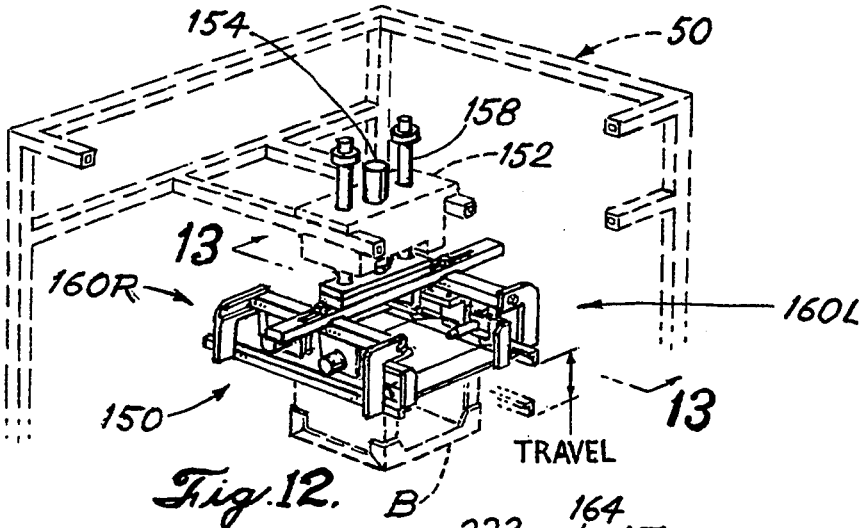
FIG. 12 is a perspective view of the fold and compression assembly, portions of the supporting framework being shown in phantom outline.

Referring to FIG. 12, an upper section of the framework 50 includes a rigid pair of cross members for mounting a fold and compression sub-assembly designated generally by the numeral 150, positioned in registered alignment with a box B occupying an indexed position. The assembly 150 includes a linear thruster body 152 rigidly secured to the frame cross members that has a vertically disposed power cylinder 154, whose force can be adjustably regulated, with a downwardly projecting piston rod fastened to the center of a cross bar 156. On opposite sides of the cylinder 154 the thruster body also mounts a pair of guide rods 158 that are vertically reciprocable through the thruster body and are rigidly connected at lower ends to a thickened mid-portion of the cross bar 156.

Opposite ends of the support bar 156 adjustably mount a pair of sub-assemblies 160L and 160R. As these are essentially mirror images of one another, it will be understood that in the ensuing description like parts of the sub-assemblies are designated by like numerals.

Figure 5:
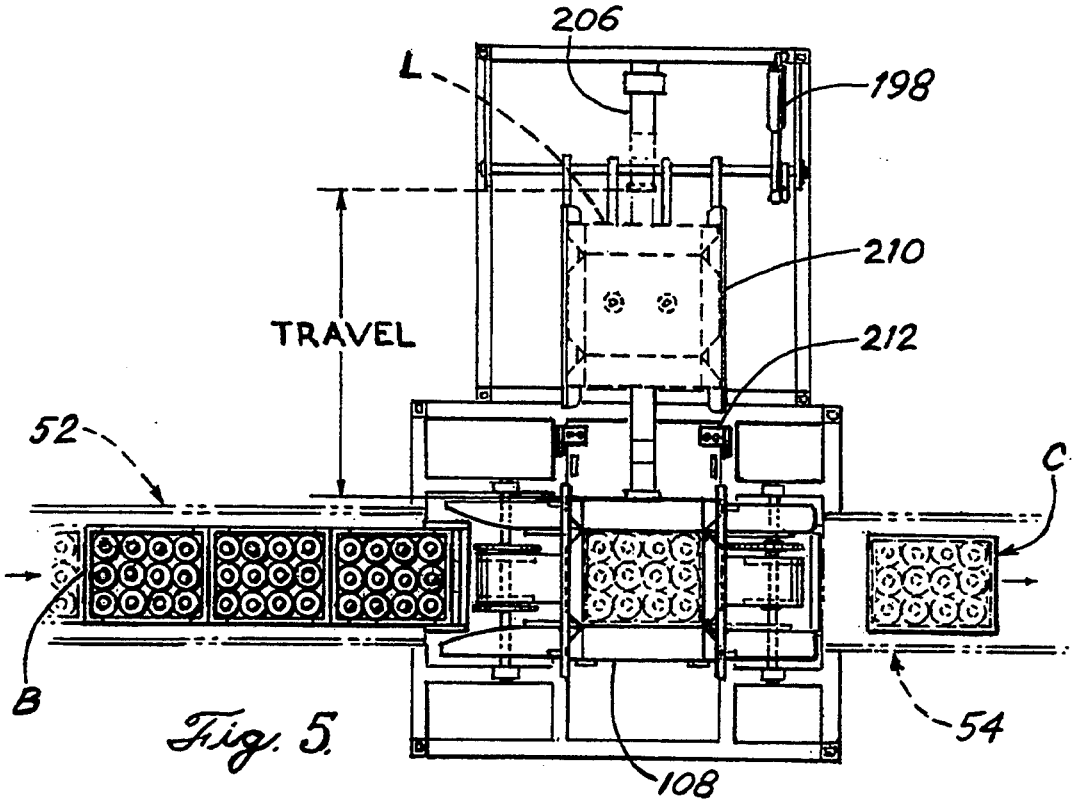
FIG. 5 is a horizontal sectional view taken on the line 5—5 of FIG. 1.

As is indicated in FIG. 5, the pair of sub-assemblies 160L and 160R are oriented parallel to and equally spaced on opposite sides of the axis on which lids L are fed into the lidding machine, at right angles to the axis of movement of the boxes B. The intersection of these axes also intersects the vertical thrust axis of the power cylinder 154 of the fold and compression assembly.

Figure 13:
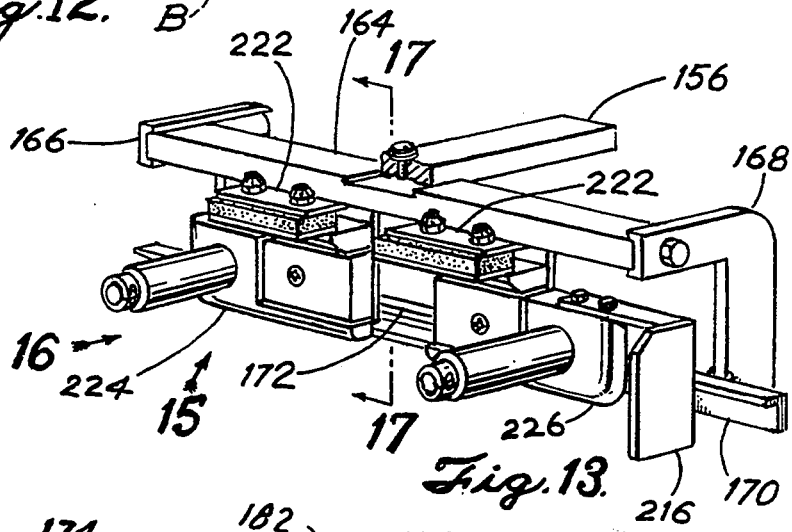
FIG. 13 is a perspective view on the line 13—13 of FIG. 12.
Figure 14:
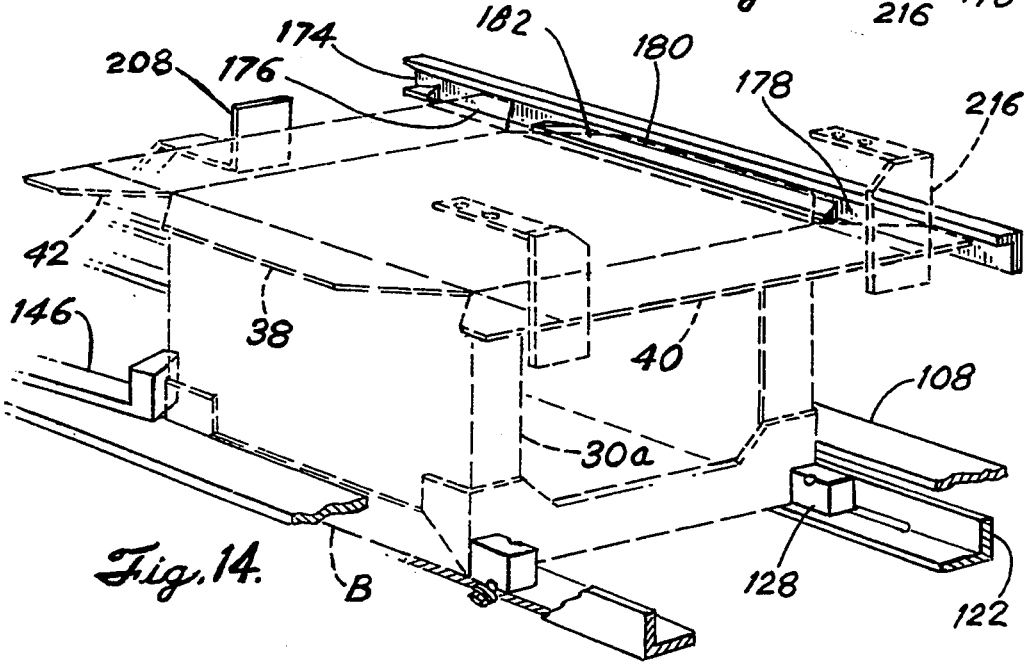
FIG. 14 is a schematic perspective view, partly in section, showing a flat lid blank in registration with an indexed box relative to certain indexing elements of the invention.
Figure 16:
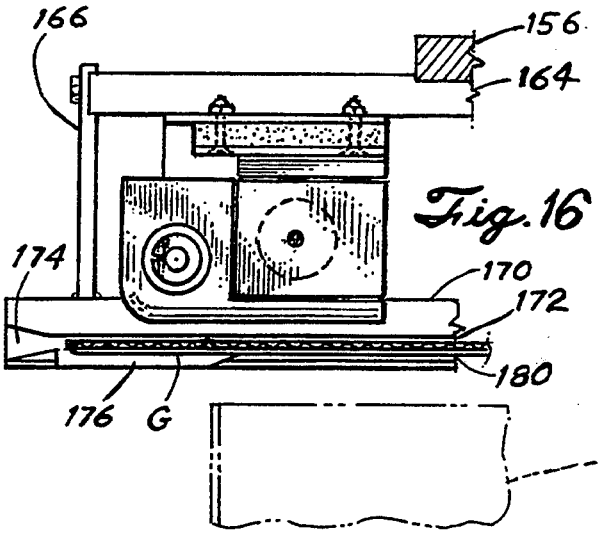
FIG. 16 is a partial elevational view taken in the direction of the arrow 16 of FIG. 13.
Figure 17:
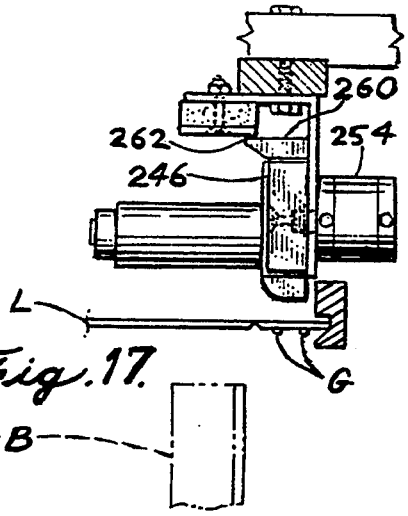
FIG. 17 is a partial sectional view on the line 17—17 of FIG. 13.
Figure 18:
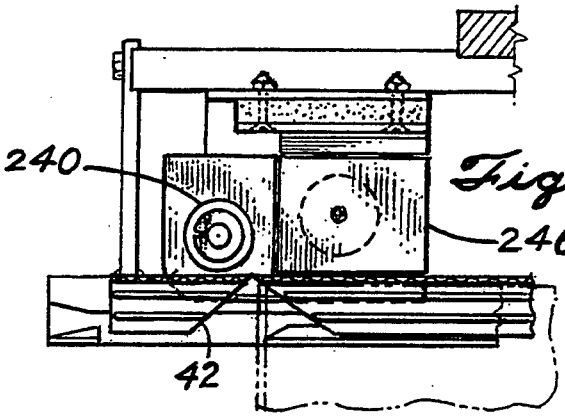
FIGS. 18, 20 and 22 are views similar to FIG. 16 but showing the parts in different relative positions.

Each of the sub-assemblies 160 includes a cross bar 164 rigidly secured at a mid point to an end portion of the thruster support bar 156. A pair of brackets 166 and 168 of inverted L-shaped configuration are rigidly secured to opposite ends of the bar 164 and, at the lower ends of the vertical legs thereof, fixedly support opposite end portions of an elongate guide rail 170. As best seen in FIGS. 13, 16, and 17, the inner face of the rail 170 is formed with an elongate guide groove 172 whose upstream end is formed with a throat section 174 that converges in the downstream direction (FIG. 16). As seen in FIG. 14, the groove 172 has a downstream relieved portion or pocket 176 and an upstream relieved portion 178, i.e., removal of metal defining the lower wall of the groove, corresponding to locations at which end tabs 42 of an indexed lid blank will be positioned in readiness for forming. A non-relieved mid portion of the groove 172 is thus defined by a segment 180 of a length approximating that of a marginal tab 38 of a lid blank L. That portion of groove 172 including segment 180 has a flap edge release configuration comprising the upwardly facing bottom face 182 of the groove that is inclined downwardly and inwardly.

Figure 4:
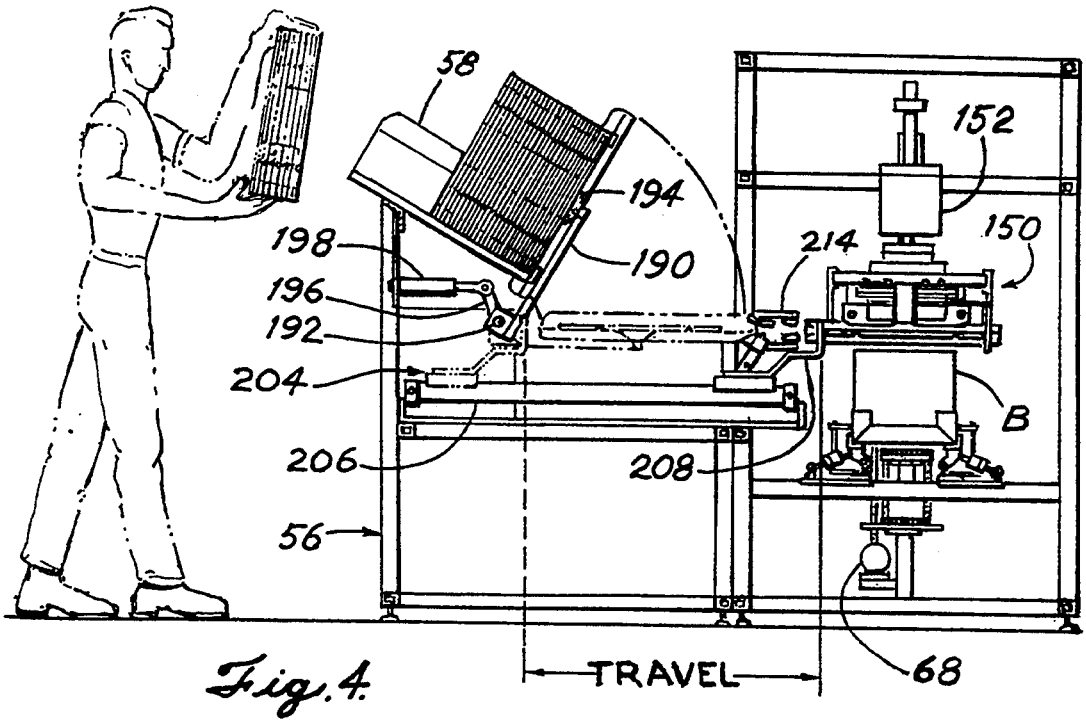
FIG. 4 is a vertical sectional view taken on the line 4—4 of FIG. 1.

Referring to FIG. 4, the side or auxiliary frame 56 comprises a lid magazine station at which a worker can load lids L into the chute 58. Chute 58 is inclined downwardly and inwardly to support a stack of generally vertical lids L in a correspondingly inclined position wherein the scored side of the lids faces downwardly and inwardly. The chute mechanism is conventional, including a gate mechanism (not shown) whereby only one lid L at a time can be plucked from the stack.

More specifically, the lid feeding mechanism comprises a suction cup frame 190 pivotally mounted at a lower end to a horizontal hinge 192. The outer swingable end portion of the frame 190 is fitted with a plurality of conventional suction cups 194. The root end of the frame 194 has a crank arm 196 pivotally connected to the outer end of the piston rod of a pneumatic cylinder 198 whose butt end is connected to the frame 56. The frame 190 is thus swingable through the arc indicated to deliver one lid L at time into a horizontal plane coincident with the grooves 172 of the guide bars 170 of the fold and compression assembly 150.

A horizontally disposed shuttle mechanism, designated generally by the numeral 204, is mounted in the frame 56 beneath the lid supply chute. The mechanism is conventional comprising an elongate horizontally disposed pneumatic tube 206 externally slidably mounting an upstanding pusher blade 208 driveably connected to the reciprocable internal piston of the cylinder 206. A lid delivered from the supply magazine is deposited onto the horizontal flanges of an opposite pair of L-shaped edge guide channels 210 so that the trailing edge of the lid blank is engagable by a vertical portion of the pusher blade 203 to be advanced into the lidding station. In a gap between downstream ends of guide channels 210 and the upstream ends of the guide grooves 172 of the assemblies 160, the framework supports an upstanding pair of glue guns 212 in alignment with the path traveled by the marginal flaps and tabs 38, 42 to deposit beads G of hot melt adhesive to the underside thereof. Mounted to the framework 50, to be engagable with a topside of a lid L passing thereunder and in opposition to the glue heads, are hold down blades 214.

As will be apparent, with the foregoing arrangement a lid blank will be shuttled out of a position at rest on the guide channels 210 into the lidding station while having the glue beads G deposited on the undersides of the marginal side flaps and tabs before the leading edge of the lid blank tabs 42 penetrate through the throats 74 of the guide slots 172 of the pair of guide bars 170. At the end of the stroke range of the piston of the pusher cylinder 206 the leading edge of the end tabs 42 and leading end flap 40 abut a pair of stop tabs 216.

The stops 216 comprise parts of the sub-assemblies 160L and 160R of the fold and compression assembly 150. More specifically, referring to FIG. 13, the bar 164 of each sub-assembly has a spaced pair of angle brackets 222 secured to the underside thereof, through a horizontal flange of the bracket. Rigidly secured to the inside face of the vertical leg of the upstream bracket 222 is a shoe means that includes shoe member 224, while the downstream bracket 222 has a shoe member 226 secured to the inside face thereof. As shown in FIG. 13, the companion stop 216 comprises an L-shaped member having a top flange secured to the upper face of the downstream shoe member 226.

The upstream shoe member 224 and downstream shoe member 226 and their associated shoe means parts adjacent each corner of the box to be lidded are mirror images of one another. As the description proceeds it will be understood that like numerals apply to like portions of both.

Figure 15:
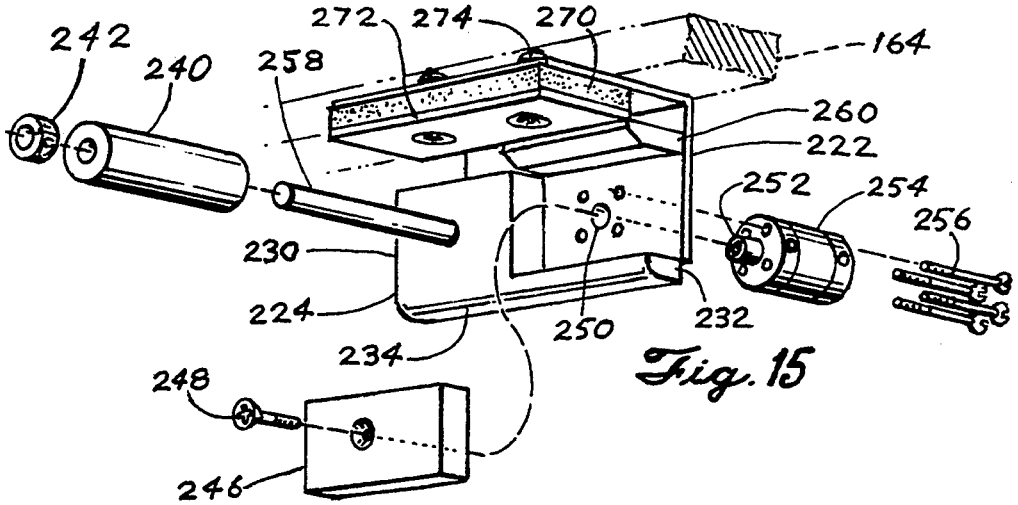
FIG. 15 is an exploded perspective view of components of a shoe means with a glue compression plate assembly, as indicated by the directional arrow 15 of FIG. 13.

Referring to FIG. 15, the shoe 224 is of somewhat L-shaped configuration comprising a substantially rectangular body portion 230 and a relatively narrow elongate arm 232. The arm 232 comprises an integral extension of the lower edge of the body portion formed with a chamfered or radius edge 234 facing downwardly and inwardly of the assembly. The shoe 224 is rigidly secured with its back flush against the inside face of the vertical flange of the bracket 222 as by means of an elongate stud 238 that projects horizontally inwardly from about the center of the body portion 230. An elongate shoe or roller 240 is rotatably mounted on stud 238 and held thereon against axial displacement by an appropriate fastener 242 securable to the outer end of the stud 238.

The location of the body of the shoe 224 on the inside face of the vertical flange of the bracket 222 defines a rectangular clearance pocket above the shoe arm 232 for the reception of a rectangular glue compression pressure plate 246. The plate 246 is centrally formed with a hole for the reception of a flush head machine screw 248 that is extendable with clearance through a hole 250 through the vertical flange of the bracket 222. The screw 248 fixedly secures the plate 246 to the outer end of a piston rod 252 that is axially reciprocable through the hole 250 upon actuation of a pressure regulatable pneumatic cylinder 254 secured to the backside of the vertical flange by means of machine screws 256 that extend through the body of the cylinder to have inner ends anchored in a hole pattern formed around the hole 250.

As shown in FIG. 17, when the cylinder 254 is deenergized the plate 246 occupies a retracted position seated against the inner face of the vertical flange of the bracket 222. At the same time, the inner face of the plate is preferably recessed with respect to the inner face of the body and arm portions of the shoe 224. When cylinder 254 is energized, as in FIG. 24, the inner face of the glue compression pressure plate 246 projects inwardly beyond the inner face of the shoe 224.

Figure 24:
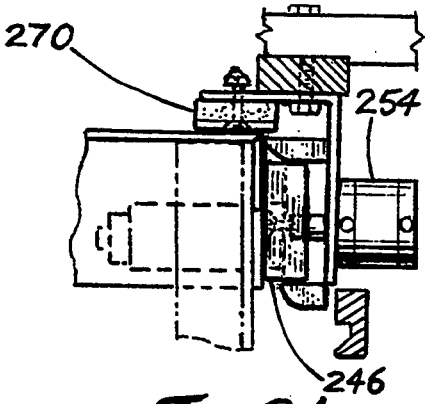

An auxiliary flap folding block 260 is secured to the inner face of the vertical flange of the bracket 222 in a position to overhang the pocket for the compression plate 246. The folding block 260 projects inwardly beyond the inner face of shoe 224 to terminate at an inner edge 262 located to define a clearance with respect to the outside face of the corresponding wall of a box B into which the thickness of a flap of the lid can be folded (FIG. 24). Inner edge 262 also develops into a downwardly and inwardly facing bevel surface 264 providing a clearance space during the sequence of folding, as will be explained later.

Referring to FIG. 15, the horizontal flange of the bracket 222 is fitted on its underside with a rectangular pad of a compressible material such as Neoprene synthetic foam rubber held in place by substantially congruent hold down plate 272 secured in place by flush headed fastener means 274. As is indicated in FIGS. 16 and 17, the pad 270 and plate 272 are of a rectangular area that registers with a corresponding rectangular corner area of the top panel 36 of a lid L and corresponding cornerpost area of a box B positioned therebeneath.

The method of operation of the lidder is as follows:

When the machine is turned on the motor 66 is energized to drive the belt 64 and driver wheels 92 at lineal speeds greatly in excess of that of the infeed conveyor means 52. The lidding station being empty, the brake shoes 122 are in the retracted lowermost position indicated in phantom outline in FIG. 10 while the fold and compression means 150 is in an elevated position having been fully retracted by the cylinder 154.

When the gate 86 is retracted by its cylinder 84, a box B is moved into the lidder by the infeed conveyor means 52. When the leading edge of the box engages the pair of driver wheels 92 the box is accelerated towards an indexed position in the lidding station by the driver wheels and belt 64. When a sensor detects that the trailing end of the box B has passed beyond gate 86, cylinder 84 is de-energized and the gate is spring snapped back into a raised position to halt the next box B on infeed conveyor means 52.

A sensor detects the penetration of the first box B into the lidding station and energizes the cylinders 136 of the pair of brake shoe assemblies 100L and 100R. Thereupon the horizontal flanges 124 of the brake shoes elevate the moving box B to the intermediate solid outline position of FIG. 10. The box then slip decelerates to come to a halt against rear faces of the stop blocks 128 of the brake shoes. In the event that the forward progress is arrested short of the stop block 28, the belt plate 56 is actuated in the manner previously described to lift the belt into contact with the box to slip-nudge it forward into the indexed position. In either event, once the indexed position has been attained by the box B, the trailing edge stops 146 are moved into the solid outline position of FIG. 8.

The box being securely locked in the first indexed position, cylinders 134 of the pair of brake shoe assemblies are activated to further lift the box into the position of FIG. 11 shown in solid outline. The vertical flanges 126 of the pair of brake shoes now clamp the box in a fully indexed and elevated position, the transverse clamp axis of the vertical flanges acting at right angles to the clamping action between the laterally swingable rear stops and leading edge stop blocks 128.

The box being now precisely located in readiness for application of a lid, the suction cup frame 190 is actuated to swing a single lid blank onto the horizontally disposed guide channels 210. The shuttle mechanism 206 is then energized to feed the lid blank past the glue guns 212 and into a fully indexed position within the fold and compression assembly against the stops 216. The lid blank comes to rest in a static position in which it is solely supported within the pair of assemblies 160L and 160R by the segment 180 defining the bottom side of the guide rail grooves 172 over the length of the marginal side flaps 38 while each of the four tabs 42 is in registration with a groove clearance pocket 176 or 178.

A lid blank now being in an accurately indexed position, cylinder 154 is then energized through a cycle of continually moving reciprocation.

Figure 19:
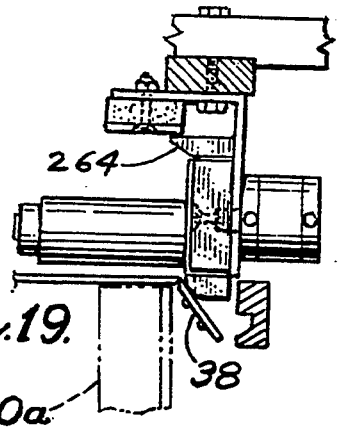
FIGS. 19, 21, 23 and 24 are views similar to FIG. 17 but showing the parts in different relative positions.

During the initial part of the downstroke of the fold and compression assembly, the lid blank is restrained in substantially flat condition by the rail grooves until the central panel 36 engages and is arrested by the upper edges of the upstanding box walls. Thereafter, the lid blank is released from its restrained flat condition during continued descent of the fold and compression assembly as the chamfered edges 234 of the shoes engage the pair of marginal side flaps 38 of the lid blank to rotate them downwardly as in FIG. 19. Referring to FIGS. 17 and 19, the profile of the grooves of the guide rails 170 defines a release configuration comprising a downwardly and inwardly sloping face 182 providing clearance for turning movement of the edge of the corresponding marginal side flap 38. Simultaneously, a portion of each chamfered edge 234 of each shoe that extends beyond the corresponsing end of a box B deflects end tabs 42 downwardly.

Figure 20:
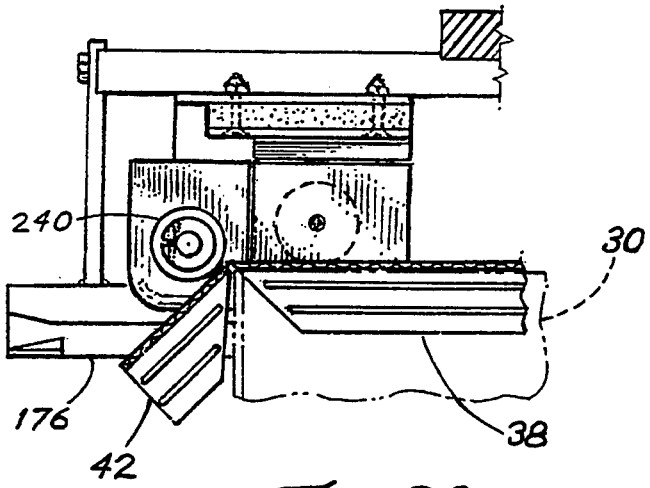
Figure 21:
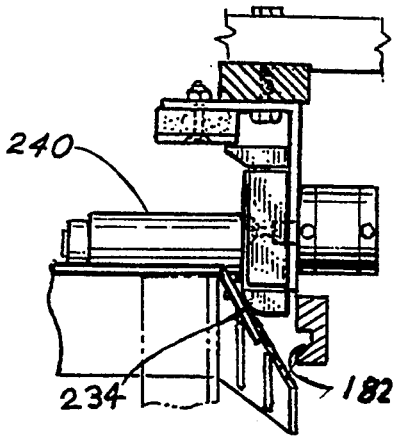

Upon continued downward movement of the fold and compression assembly to the condition depicted in FIGS. 20 and 21, rollers 240 engage the opposite end marginal flaps 40 of the lid to turn them downwardly. Simultaneously the end tabs 42 are further cammed downwardly and inwardly by chamfered edges 234 of the shoes.

Figure 22:
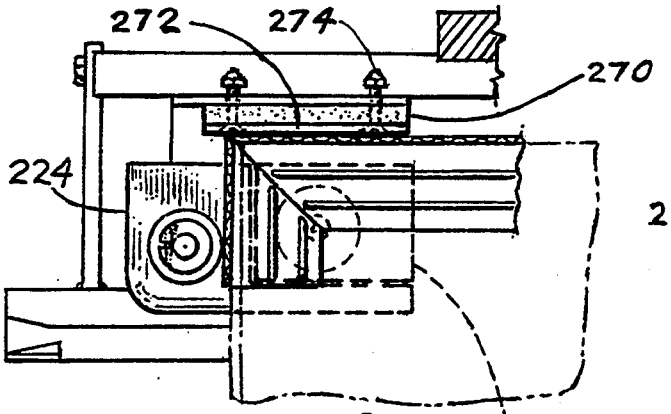
Figure 23:
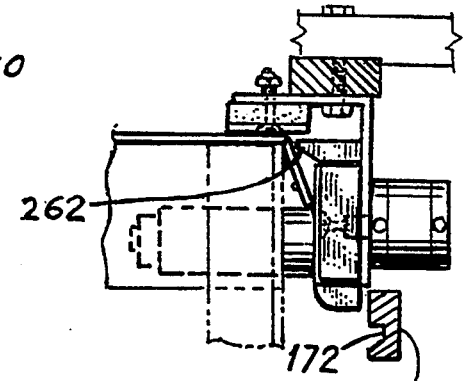

As the fold and compression assembly descends from the position of FIGS. 20 and 21 to the position of FIGS. 22 and 23, the hold down plate 272 at each corner comes into contact with the upper surface of a corner area of panel 36 of the lid whereupon compression of the pad 270 is initiated. At the same time, as shown in FIG. 23, the clearance bevel 264 on the block 260 permits the edge of the flap to come into engagement with the inner face of the corresponding shoe.

When the fold and compression assembly attains the nadir of the stroke, as in FIG. 24, the inner edge 262 of the block 260 engages the outer surface of the corresponding marginal side flap 38 and the cylinder 254 at each corner is energized to forcibly thrust the inner face of the glue compression plate 246 against the flap. The glue beads G are thereupon compressed and dispersed but without deflection of the wall of the box because of the vertical force imposed by the hold down plate 272 and pad 270 prior to the imposition of the force of the plate 246.

The lid L now being fully formed and adhesively secured to a box B, the cylinders 254 are de-energized and the pressure plates 246 retracted so that ample clearance is allowed within the fold and compression assembly, which can now be freely retracted to the fully elevated position.

When the fold and compression assembly is in the fully raised position the cylinders 134, 136 of the pair of brake shoe assemblies are now de-energized to lower the box into contact with the continually moving belt 64. The shoes 122 reaching a fully retracted position, the box is now accelerated past the exit roller 80 and onto the output conveyor means 54.

Referring to FIGS. 22–23, particular note should be taken of the relationship of the footprint of the area of the inner face of the glue compression plate 246 relative to areas of the corresponding cornerpost of the box B. The horizontal upper edge of the plate 246 is spaced from the upper edge of the side wall 30 of the box and that vertical edge of the plate (e.g., the left edge as viewed in FIG. 22 in phantom outline) is spaced from the flange **30*a* of the cornerpost area by a margin, e.g., ½ inch, leaving a sufficient clear span, e.g., the ½ inch margin, such that the considerable compressive load imposed on the cornerpost by hold down plate 272** (e.g., up to about 80 pounds for 250 pound C flute material)

will not allow displacement of the box wall 30 when the corresponding glue compression plate 254 is actuated, as in FIG. 24. This arrangement insures that the inside surfaces of the glued portions of the end tab 42 and area of flap 38 come into faying contact to successfully compress and disperse the glue of the beads G.

We claim:

1. A box lidding machine comprising:

a framework mounting a horizontally disposed conveyor means having entrance and exit ends, said conveyor means passing through a lidding station of said framework;

a gate means at said entrance end for sequentially admitting one box at a time to said conveyor means;

accelerator means positioned adjacent to said gate means for accelerating a box admitted by said gate means downstream to be carried into said lidding station by said conveyor means;

a brake means within said lidding station for decelerating a box on said conveyor means, said brake means being movable between inactive and active positions thereof that are, respectively, out of and in contact with a box moving on said conveyor means;

means for moving said brake means between said inactive and active positions;

said brake means when moving to said active position moving a box out of contact with said conveyor means to be decelerated by said brake means;

a stop means on said brake means for arresting a box on said brake means within said lidding station;

said brake means when moving from said active position into said inactive position moving a lidded box into contact with said conveyor means to be carried towards said exit end.

2. A box lidding machine as in claim 1 in which:

said conveyor means comprises an endless belt and said entrance end comprises a roll around which said belt is trained;

said accelerator means comprising a driver wheel mounted coaxially with said roll and having a radius larger than the effective radius of said belt and roll at said entrance end.

3. A box lidding machine as in claim 1 in which:

said brake means comprises a pair of elongate horizontally disposed brake shoes mounted on opposite sides of and parallel to a mid-line of said conveyor means, each of said brake shoes comprising a horizontal surface that in said inactive position is lower than the surface of said conveyor means, said pair of brake shoes when moving to said active position lifting a box out of contact with said conveyor means to frictionally decelerate a box on said horizontal surfaces.

4. A box lidding machine as in claim 3 in which:

each of said brake shoes comprises a generally L-shaped in cross-section member in which said horizontal surface comprises a generally horizontal flange of said L-shaped member;

each of said L-shaped members comprising a generally vertical flange, said pair of vertical flanges in said active position of said brake means being spaced apart a distance to clamp the opposite sides of a box therebetween.

5. A box lidding machine as in claim 4 in which:

said means for moving said brake means is operable to arrest said brake means in an intermediate position between said inactive and active positions of said brake means;

said pair of brake shoes when moving to said intermediate position from said inactive position lifting a box out of contact with said conveyor means while said pair of vertical flanges are disengaged from the opposite sides of a box therebetween.

6. A box lidding machine as in claim 5 in which:

said conveyor means comprises an endless belt;

said framework mounting a plate positioned beneath an upper flight of said endless belt that is movable between extended and retracted positions thereof, said plate being movable to said extended position when said brake shoes are in said intermediate position to engage said top flight of said endless belt for advancing a box into contact with said stop means.

7. A box lidding machine comprising:

a framework comprising a lidding station;

indexing means for supporting an open box in said lidding station to have a lid formed out of a flat blank and secured to the open top of the box;

a sub-assembly mounted in said lidding station for vertical reciprocation and positioned in substantially centered relationship with respect to a box indexed in said lidding station;

means for reciprocating said sub-assembly between raised and lowered positions;

a pair of parallel rails fixedly mounted on opposite sides of said sub-assembly laterally spaced apart to pass with clearance a pair of opposite sides of the top of a box in said lidding station during reciprocation of said sub-assembly;

said pair of rails being formed on confronting inner faces thereof with substantially coplanar grooves to receive a pair of opposite edges of marginal flaps of a lid blank;

lid blank indexing means including said pair of grooves for substantially horizontally supporting a lid blank in substantially centered relationship with respect to a box indexed in said lidding station;

shoe means fixedly mounted on opposite sides of said subassembly in alignment with the marginal flaps of an indexed lid blank;

said pair of grooves supporting the lid blank in substantially planar condition during descent of said sub-assembly until the lid engages and is arrested by the top of a box in said lidding station, each of said shoe means having a lower edge spaced above the plane of said grooves engagable with a flap of the lid blank for rotating the flap relative to an upper edge of a box during part of an initial descent of said sub-assembly, each of said grooves having a release configuration such that the edges of the marginal flaps of the lid blank are rotatable out of and released from said grooves upon continued descent of said sub-assembly.

8. A box lidding machine as in claim 7 in which:

each of said grooves has a profile comprising a top face to downwardly confront the top side of a marginal flap of a lid blank and a bottom face to upwardly confront the bottom side of a marginal flap of a lid blank, said bottom face of said groove being inclined downwardly and inwardly to comprise said release configuration of said groove whereby clearance is provided for the edge of a marginal flap of a lid blank to rotate out of said groove upon said continued descent of said sub-assembly.

9. A box lidding machine as in claim 7 in which:

each of said shoe means has an inner face located for partially folding the marginal flap of a lid blank towards the side of an indexed box during descent of said sub-assembly;

each of said shoe means comprising an auxiliary folding block for fully folding the marginal flap during a terminal part of descent of said sub-assembly, said auxiliary folding block having an inner edge engagable with the marginal flap as said sub-assembly reaches the nadir of descent of said sub-assembly.

10. A box lidding machine as in claim 9 in which:

each of said shoe means comprises a pressure plate positioned between said auxiliary folding block and said lower edge of said shoe means, said pressure plate being retractable to a position in which an inner face of said pressure plate is spaced outwardly with respect to said inner edge of said auxiliary folding block, said pressure plate being movable to an extended position in which said inner face of said pressure plate presses a marginal flap against the corresponding side of a box in indexed position.

11. A box lidding machine as in claim 10 in which:

said sub-assembly has a pair of said shoe means fixedly mounted on opposite sides of said sub-assembly in operative alignment with cornerpost areas of an indexed box;

said sub-assembly mounting a pair of hold down plate means on opposite sides of said sub-assembly, each of said hold down plate means having a downwardly facing surface in alignment with a corner area of the central panel of a lid blank and upstanding walls of the cornerpost area of an indexed box;

said hold down plates being positioned to engage the corner areas of the central panel of a lid as said sub-assembly approaches the nadir of its stroke to apply a compressive force on the lid and cornerpost areas of the indexed box;

said pressure plates being extendable to an extended position after the compressive force of said hold down plates is imposed.

12. A box lidding machine as in claim 11 in which:

each of said hold down plate means comprises a compressable pad between a pair of rigid plates.

13. A box lidding machine as in claim 7 in which:

said sub-assembly has a pair of said shoe means fixedly mounted on opposite sides of said sub-assembly in operative alignment with cornerpost areas of an indexed box;

each of said shoe means having said lower edge also spaced above the tab of an end panel of an indexed lid blank;

said lower edge of said shoe means also being engagable with a tab of an end flap to initially rotate the tab during part of an initial descent of said sub-assembly;

each of said shoe means comprising a horizontally disposed roller projecting at an angle to said lower edge in alignment with an end flap of the box lid blank and positioned upwardly relative to said lower edge for rotating the end flap and tab after initial rotation of the tab by said lower edge.

14. A box lidding machine as in claim 7 in which:

said lidding station comprises a horizontally disposed conveyor means having entrance and exit ends;

a gate means at said entrance end for sequentially admitting one box at a time to said conveyor means;

accelerator means positioned adjacent to said gate means for accelerating a box admitted by said gate means downstream to be carried into said lidding station by said conveyor means;

said indexing means for supporting an open box in said lidding station comprising a brake means, means for moving said brake means between inactive and active positions, and a stop means on said brake means for arresting a box on said brake means;

said brake means when moving to said active position moving a box out of contact with said conveyor means to be decelerated by said brake means;

said brake means when moving from said active position into said inactive position moving a lidded box into contact with said conveyor means to be carried towards said exit end.

15. A box lidding machine as in claim 14 in which:

said brake means comprises a pair of elongate horizontally disposed shoes mounted on opposite sides of and parallel to a mid-line of said conveyor means, each of said brake shoes comprising a horizontal surface that in said inactive position is lower than the surface of said conveyer means, said pair of brake shoes when moving to said active position lifting a box out of contact with said conveyor means to frictionally decelerate a box on said horizontal surfaces.

16. A box lidding machine as in claim 15 in which:

each of said brake shoes comprises a generally L-shaped in cross-section member in which said horizontal surface comprises a generally horizontal flange of said L-shaped member;

each of said L-shaped members comprising a generally vertical flange, said pair of vertical flanges in said active position of said brake means being spaced apart a distance to clamp the opposite sides of a box therebetween.

17. A box lidding machine as in claim 16 in which:

said means for moving said brake means is operable to arrest said brake means in an intermediate position between said active and inactive positions of said brake means;

said pair of brake shoes when moving to said intermediate position from said inactive position lifting a box out of contact with said conveyor means while said pair of vertical flanges are disengaged from the opposite sides of a box therebetween.

18. A method of lidding an open top box with a lid formed from a flat lid blank having a central panel flanked by an integral opposite pair of foldable side flaps, said method comprising:

positioning the box and lid blank in mutually centered relationship with the central panel in registration with the open top of the box while maintaining clearances for unobstructed rotation of the side flaps of the centered lid blank towards the box;

restraining the lid blank in substantially flat condition while maintaining the clearances and bringing the central panel of the lid blank and open top of the box into mutually centered contact; and releasing the lid blank from restrained flat condition by rotating the side flaps towards the box through the clearances.

19. The method of claim 18, the lid blank being further characterized in having an integral pair of foldable end flaps, each of the end flaps having an integral pair of foldable side tabs, said method being further characterized by rotating the end tabs towards the box substantially concurrently with rotating the side flaps towards the box.

20. The method of claim 19 further characterized by:

rotating the side flaps and end flaps into contact with the box;

compressively loading corner areas of the central panel of the lid blank and the underlying corner-post areas of the box; and thereafter pressing the end tabs and side flaps against the box.

21. The method of claim 18 further characterized by:

rotating the side flaps into contact with the box;

compressively loading the central panel of the lid blank on the box; and pressing the side flaps against the box.

22. The method of claim 21 further characterized by:

pressing the side flaps against the box in areas of each side flap spaced from the upper and vertical edges of the corresponding walls of the box.

* * * * *